US007218884B2

(12) United States Patent
Miyazaki

(10) Patent No.: US 7,218,884 B2
(45) Date of Patent: May 15, 2007

(54) FIXING DEVICE

(75) Inventor: Masami Miyazaki, Itami (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 225 days.

(21) Appl. No.: 11/016,954

(22) Filed: Dec. 21, 2004

(65) Prior Publication Data

US 2006/0099015 A1 May 11, 2006

(30) Foreign Application Priority Data

Nov. 9, 2004 (JP) ..... 2004-325382

(51) Int. Cl.
*G03G 15/20* (2006.01)

(52) U.S. Cl. ..... 399/328; 219/216; 399/122; 399/330

(58) Field of Classification Search ..... 399/122, 399/327, 328, 329, 330; 219/216, 619, 675
See application file for complete search history.

(56) References Cited

U.S. PATENT DOCUMENTS 6,671,488 B2 * 12/2003 Izawa et al. ..... 399/329
6,704,537 B2 * 3/2004 Takeuchi et al. ..... 399/328

FOREIGN PATENT DOCUMENTS

| | | | |
|---|---|---|---|
| JP | 57-37382 | A | 3/1982 |
| JP | 4-235029 | A | 8/1992 |
| JP | 10-074008 | | 3/1998 |
| JP | 11-30924 | A | 2/1999 |
| JP | 2000-214714 | | 8/2000 |
| JP | 2000-250337 | | 9/2000 |
| JP | 2001-109302 | A | 4/2001 |
| JP | 2001-313161 | A | 11/2001 |
| JP | 2002-093566 | | 3/2002 |
| JP | 2002-367766 | A | 12/2002 |
| JP | 2003-084591 | | 3/2003 |

* cited by examiner

*Primary Examiner*—Hoan Tran
(74) *Attorney, Agent, or Firm*—Buchanan Ingersoll & Rooney PC

(57) ABSTRACT

A fixing device has a fixing roller including an inside roller, an outside roller and a regulation member. The regulation member is disposed outside of both ends of the outside roller in the axial direction to regulate axial movement of the outside roller. An axial length of the contact face, where the pressure roller contacts with the outside roller, is smaller than an axial length of the outside roller. Thereby, both ends of the outside roller hardly receive bending deformation caused by pressure of the pressure roller. This makes it possible to reduce stress exerted to both ends of the outside roller, and therefore, the ends of the fixing roller are prevented from being damaged to enhance durability of the fixing roller.

14 Claims, 10 Drawing Sheets

FIXING DEVICE

CROSS-REFERENCE TO RELATED APPLICATIONS

This application is based on application No. 2004-325382 filed in Japan, the entire content of which is hereby incorporated by reference.

BACKGROUND OF THE INVENTION

The present invention relates to a fixing device for use in an electrophotographic image forming apparatus such as a copier, a laser printer and a facsimile.

In the fixing device, it has been considered to adopt an induction heating type of heat source which offers high thermal conversion efficiency in order to achieve energy saving. Particularly, from view-point of their compact design and high efficiency, attention is focus on the fixing device in which magnetic flux generated by coils is guided to a fixing roller by a core member such as ferrite cores.

This conventional electromagnetic induction heating type of fixing device includes a fixing roller, a pressure roller which comes in contact with the fixing roller to form a nip, and a magnetic flux generation means which is disposed inside of the fixing roller to generate magnetic flux.

The fixing roller generates heat by the magnetic flux from the magnetic flux generation means. The nip holds and transports a recording material carrying an unfixed image so that the unfixed image is melted by the heat and fixed to the recording material (see JP 10-74008A)

The fixing roller includes an outside roller for generating heat by virtue of magnetic flux, an inside roller inserted into the inside of the outside roller, and a regulation member disposed on both ends of the outside roller in order to suppress movement of the outside roller in relation to the inside roller in the axial direction.

In the conventional fixing device, however, an axial length of a contact face of the pressure roller that comes in contact with the outside roller is almost equal to an axial length of the outside roller. Therefore, when the fixing roller and the pressure roller rotate while the pressure roller is in contact (pressurized contact) with the fixing roller, the outside roller of the fixing roller suffers elastic deformation caused by the pressure roller and develops bending deformation during rotation.

Thus, since both ends of the outside roller rotate while developing the bending deformation, stress is generated between both ends of the outside roller and the regulation member, which may cause damage on the ends of the fixing roller.

SUMMARY OF THE INVENTION

An object of the present invention is therefore to provide a fixing device capable of suppressing bending deformation on both ends of an outside roller in a fixing roller when the fixing roller and a pressure roller rotate while the pressure roller is in contact with the fixing roller so as to prevent the ends of the fixing roller from being damaged and to enhance durability of the fixing roller.

In order to achieve the above-mentioned object, a first aspect of the present invention provides a fixing device, comprises an outside roller having an electromagnetic induction heating layer, an inside roller inserted into the outside roller, having a sponge layer and rotatably supported, a regulation member for prohibiting the outside roller from moving in an axial direction in relation to the inside roller, an induction coil for generating magnetic flux in the electromagnetic induction heating layer of the outside roller, and a pressure roller disposed in pressurized contact with the outside roller, the pressure roller being shorter than the outside roller in an axial direction.

Herein, the contact face of the pressure roller is defined as a contact trace of the fixing roller, which trace is formed on the outer peripheral face of the pressure roller by the fixing roller when the pressure roller rotates at least once while being in contact with the fixing roller.

According to the first aspect of the present invention, an axial length of the contact face of the pressure roller, which comes in contact with the outside roller in the fixing roller, is smaller than an axial length of the outside roller in the fixing roller. Therefore, when the fixing roller and the pressure roller rotate while the pressure roller is in contact with the fixing roller, both ends of the outside roller in the fixing roller is less susceptible to bending deformation (elastic deformation) caused by pressure of the pressure roller.

Thus, the bending deformation is decreased on both ends of the outside roller in the fixing roller. This suppresses generation of stress between the suppression member and the ends of the outside roller, and therefore, it becomes possible to prevent the ends of the fixing roller from being damaged and to enhance durability of the fixing roller.

The fixing device also has a regulation member, and therefore, the outside roller is prohibited from moving in the axial direction in relation to the inside roller.

A Second aspect of the present invention provides a fixing device, comprises an outside roller having an electromagnetic induction heating layer, an inside roller inserted into the outside roller, having a sponge layer and rotatably supported, a regulation member provided on both ends of the inside roller and coming in contact with an end of the outside roller so as to prohibit the outside roller from moving in the axial direction, an induction coil for generating magnetic flux in the electromagnetic induction heating layer of the outside roller, and a pressure roller disposed in pressurized contact with the outside roller, the pressure roller being shorter than the outside roller in the axial direction.

According to the second aspect of the present invention, the fixing device is provided with a regulation member on both sides of the inside roller. Therefore, the regulation member prohibits the outside roller from moving, for example meandering or one-directional deviation, in the axial direction in relation to the inside roller when the outer roller and the pressure roller rotate in contact with each other.

A third aspect of the present invention provides a fixing device, comprises an outside roller having an electromagnetic induction heating layer, an inside roller inserted into the outside roller, having a sponge layer and rotatably supported, the inside roller being bonded to the outside roller on both ends other than a center portion of the outside roller, an induction coil for generating magnetic flux in the electromagnetic induction heating layer of the outside roller, and a pressure roller disposed in pressurized contact with the outside roller, the pressure roller being shorter than the outside roller in an axial direction.

According to the third aspect of the present invention, the pressure roller is shorter than the outside roller in the axial direction. Thus, the adhesion regions on both ends of the outside roller hardly receive the bending deformation caused by pressure of the pressure roller. This makes it possible to prevent the adhesive agent between both ends of the outside roller and the inside roller from coming off, so that durability of the fixing roller is maintained.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinbelow, the present invention will be described in detail in conjunction with embodiments with reference to the accompanying drawings.

First Embodiment

Figure 1:
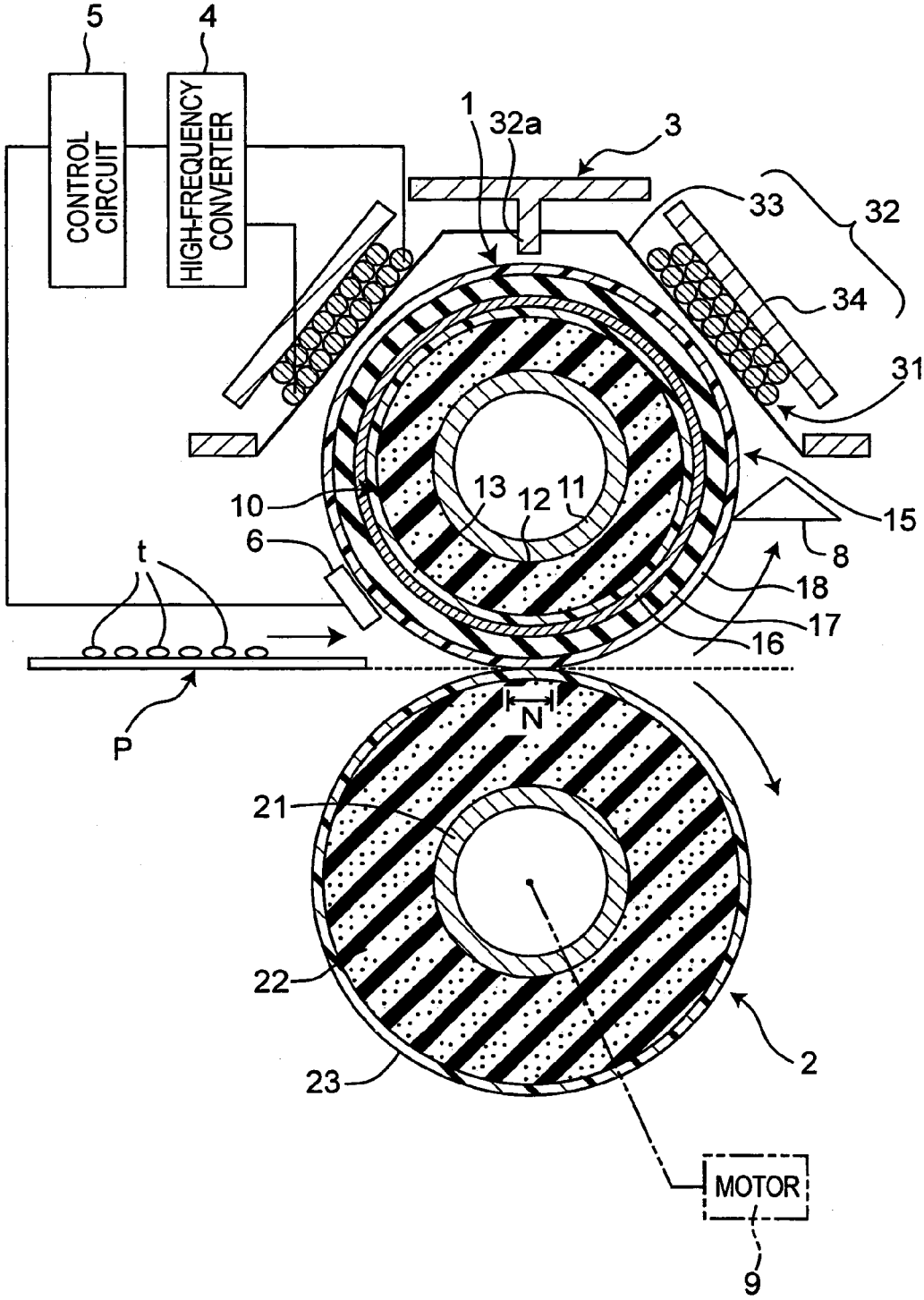
FIG. 1 is a cross sectional view showing a fixing device in one embodiment of the present invention.

FIG. 1 is a cross sectional configuration view of a fixing device according to a first embodiment of the present invention. As shown in FIG. 1, the fixing device, which is of induction heating type, includes an electromagnetic induction heating-type fixing roller 1, a pressure roller 2 which contacts with the fixing roller 1 to form a nip N, and a magnetic flux generation means 3 disposed outside of the fixing roller 1 for generating magnetic flux.

The fixing roller 1 generates heat by virtue of magnetic flux from the magnetic flux generation means 3. Thereafter, a recording material P carrying an unfixed image t is passed through between the fixing roller 1 and the pressure roller 2. Thereby, the unfixed image t is melted and fixed (heated and fixed) to the recording material P while the recording material P is held and transported by the nip N.

The fixing device, together with an imaging means (unshown) for forming the unfixed image t on the recording material P, constitutes an image forming apparatus such as a copier, a laser printer and a facsimile.

The recording material P is typified by recording materials such as paper sheets and OHP sheets. The unfixed image t is typified by thermally meltable toners formed by resin, magnetic material, colorant and so on.

The fixing roller 1 and the pressure roller 2 are parallel disposed opposite to each other. Both end sides of each roller are rotatably supported by bearing members (unshown). The fixing roller 1 is biased toward the axis of the pressure roller 2 by an pressure mechanism (unshown) such as springs, so that the fixing roller 1 is brought into pressurized contact with the outer surface of the pressure roller 2 with a specified pressure to form the nip N.

The pressure roller 2 is driven by a drive means 9 such as a motor to rotate clockwise as shown by an arrow at a specified peripheral velocity. The fixing roller 1 follows the rotation of the pressure roller 2 so as to be rotated by friction of pressurized contact with the pressure roller 2 at the nip N.

Figure 2:
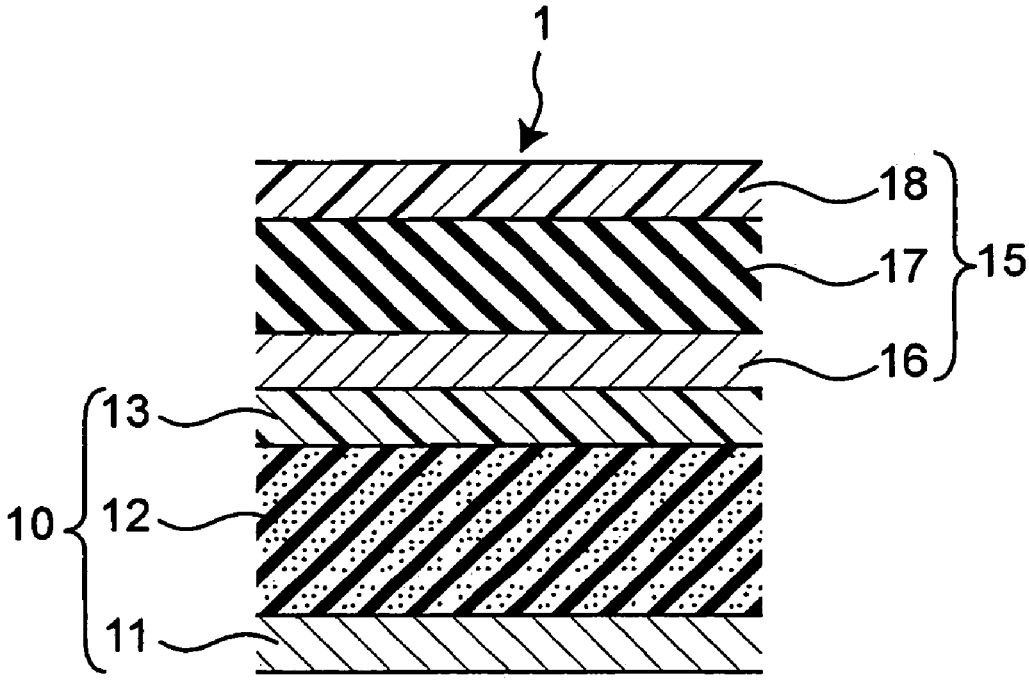
FIG. 2 is an enlarged cross sectional view showing layers of a fixing roller.

As shown in FIGS. 1 and 2, the fixing roller 1 has an outside roller 15, and an inside roller 10 inserted into the inside of the outside roller 15 without being bonded thereto.

The inside roller 10 has a support layer 11, a sponge layer 12 and a protective layer 13 which are disposed in sequence from the inside to the outside in the radial direction. Each layer is fastened so as not to rotate in relation to each other. The outside roller 15 has an electromagnetic induction heating layer 16, an elastic layer 17 and a release layer 18, which are disposed in sequence from the inside to the outside in the radial direction. Each layer is also fastened so as not to rotate in relation to each other. The outer diameter of the inside roller 10 is almost equal to the inner diameter of the outside roller 15.

The support layer 11 is formed by, for example, an aluminum cylindrical cored bar having an outer diameter of 40 mm and a thickness of 3 mm. It is to be noted that a steel pipe or a heat-resistant molded pipe made of PPS (polyphenylene sulfide) etc. may be used for the support layer 11 if the strength of the material can be ensured. Preferably, nonmagnetic materials less susceptible to electromagnetic induction heating is used for the support layer 11 to prevent the cored bar from generating heat.

The sponge layer 12, which serves to insulate and retain heat generated in the electromagnetic induction heating layer 16, is formed from a sponge article (thermal insulation structure) made of rubber materials or resin materials having heat resistance and elasticity. The sponge layer 12 reliably insulates the electromagnetic induction heating layer 16 and retains heat therein. Also, the sponge layer 12 allows the electromagnetic induction heating layer 16 to deform, so that a width size of the nip N increases. Further, hardness of the fixing roller 1 can be set smaller than that of the pressure roller 2 so as to enhance paper ejection capability and recording material separating function. For example, when using a silicon sponge material for the sponge layer 12, the thickness of the sponge layer 12 is set at 2 to 10 mm, preferably 3 to 7 mm, and the hardness based on ASKER Rubber Hardness Tester is set at 20 to 60 degrees, preferably 30 to 50 degrees.

The protective layer 13 serves to reduce friction with the inner surface of the electromagnetic induction heating layer 16 and to suppress an axial movement (e.g. meandering) of the outside roller 15, and is preferably made of, for example, fluorocarbon resin such as PFA, PTFE, FEP and PFEP. The thickness of the protective layer 13 is preferably 5 to 100 μm, and more preferably 10 to 50 μm.

The electromagnetic induction heating layer 16 is, for example, an endless belt layer made of nickel by electroforming, which layer has a thickness of 10 to 100 μm, preferably 20 to 50 μm. Magnetic material (magnetic metal) such as magnetic stainless steel having relatively high magnetic permeability μ and appropriate resistivity ρ may be used as other materials of the electromagnetic induction heating layer 16. Moreover, electrically conductive material such as metal may be used by, for example, being formed into thin film even if the electrically conductive material is nonmagnetic. Further, the electromagnetic induction heating layer 16 may be formed by resin and heat generating particles dispersed therein. The electromagnetic induction heating layer 16 using a resin-based material makes it possible to further enhance the separability of the recording material P.

In the electromagnetic induction heating layer 16, an eddy current is generated by the magnetic flux from the magnetic flux generation means 3, so that Joule heat is generated to then heat the fixing roller 1. This heating is referred to as electromagnetic induction heating.

The elastic layer 17 is made of a rubber material or a resin material having heat resistance and elasticity to enhance adhesion between the recording material P and the surface of the fixing roller 1. The elastic layer 17 is made of, for example, heat-resistant elastomer such as silicon rubber and fluorocarbon rubber which allow use at a fixing temperature. The elastic layer 17 may be doped with various fillers for the purpose of gaining thermal conductivity and reinforcement. Thermal conductive particles for this purpose include diamond, silver, copper, aluminum, marble, glass and so on. More practically, silica, alumina, magnesium oxide, boron nitride and beryllium oxide are used.

The thickness of the elastic layer 17 is preferably 10 to 800 μm, and more preferably 100 to 300 μm. If the thickness of the elastic layer 17 is less than 10 μm, it becomes difficult to gain elasticity in the thickness direction. On the other hand, if the thickness of the elastic layer 17 is more than 800 μm, it becomes difficult for heat generated in the electromagnetic induction heating layer 16 to reach the outer circumferential surface of the fixing roller 1. Therefore, thermal efficiency tends to deteriorate.

The hardness of the elastic layer 17 according to JIS Hardness is preferably 1 to 80 degrees and more preferably 5 to 30 degrees, which makes it possible to prevent fixing failure of the unfixed image (toner) t while preventing decrease in strength and adhesion failure in the elastic layer 17. In this case, the elastic layer 17 is preferably made of silicon rubber. More specifically, the silicon rubber may include silicon rubber of one-component system, two-component system, three-component system or silicon rubber of higher-component system, silicon rubber of LTV-type, RTV-type or HTV-type, and silicon rubber of condensation-type or addition-type. In this embodiment, the elastic layer 17 is silicon rubber with a JIS hardness of 10 degrees and a thickness of 200 μm.

The release layer 18 increases the release ability of the surface of the fixing roller 1. The release layer 18 used at a fixing temperature has toner release ability. The release layer 18 is made of, for example, silicon rubber, fluorocarbon rubber, and fluorocarbon resin such as PFA, PTFE, FEP and PFEP. The thickness of the release layer 18 is preferably 5 to 100 μm, and more preferably 10 to 50 μm. The release layer 18 may be doped with an electrically conductive material, a abrasion-resistant material and a good thermal conductive material as fillers. Further, in order to enhance interlayer adhesion, bonding treatment may be performed by primer and the like.

As shown in FIG. 1, the pressure roller 2 has a support layer 21, a sponge layer 22 and a release layer 23, which are disposed in sequence from the inside to the outside in the radial direction. The support layer 21, the sponge layer 22 and the release layer 23 in the pressure roller 2 are similar to the support layer 11, the sponge layer 12 and the release layer 18 in the fixing roller 1, respectively.

The support layer 21 is a cored bar made of aluminum with an outer diameter of 20 mm and a thickness of 3 mm. The sponge layer 22 is made out of silicon sponge rubber with a thickness of 7 mm. The release layer 23 is made of fluorinated resin such as PTFE and PFA with a thickness of 10 to 50 μm.

As the support layer 21, a heat-resistant molded pipe made of a material such as steel or PPS (polyphenylene sulfide) may be used if the strength of the material can be ensured. For the support layer 21, however, it is preferably to use nonmagnetic materials less susceptible to electromagnetic induction heating for preventing the cored bar from generating heat. Solid rubber may be used as the sponge layer 22 instead of the silicon sponge rubber for further enhancement of the release ability.

The pressure roller 2 is pressed to the fixing roller 1 with a load of 300 to 500N. In this case, the width size of the nip N (size of the recording material P in the transportation direction) is approx. 5 to 10 mm. It is naturally acceptable to change the load so as to change the width size of the nip N.

As shown in FIG. 1, the magnetic flux generation means 3 includes a trembler coil 31 and a magnetic substance core 32. The magnetic flux generation means 3 is disposed outside of the fixing roller 1 in the state of facing the fixing roller 1 along the longitudinal direction of the fixing roller 1.

The magnetic substance core 32 includes a coil bobbin 33 which has a cup shape (trapezoid) with an open lower end in transverse section, and a cover member 34 which covers the coil bobbin 33 provided with a specified space therebetween. The magnetic substance core 32, which is a long member having a length size almost corresponding to the axial size of the fixing roller 1, covers almost the half of the fixing roller 1 inside the coil bobbin 33 in transverse section.

The magnetic substance core 32 has a protruding portion 32*a* in the middle section. The protruding portion 32*a* protrudes on the side of the fixing roller 1 to increase heat generating efficiency of the fixing roller 1. The magnetic substance core 32 should be made of a material with high magnetic permeability and low magnetic loss. In the case where alloy such as permalloy is used, the magnetic substance core 32 may be given a laminated structure since a loss of eddy current inside the magnetic substance core 32 is increased due to high frequency.

The magnetic substance core 32 is used for increase in the efficiency of a magnetic circuit and for shield of magnetism. If the magnetic circuit portion of the trembler coil 31 and the magnetic substance core 32 has a means for providing sufficient magnetic shielding, then the protruding portion 32*a* may be eliminated. Further, in the case where a resin material with magnetic powders dispersed therein is used, magnetic permeability becomes relatively low though the shape can be set freely.

The trembler coil 31, which is present in a space between the coil bobbin 33 and the cover member 34, is of structure where a lead wire is wound along the long coil bobbin 33 in the longitudinal direction. The trembler coil 31 has a trapezoid shape in transverse section.

The trembler coil 31 is connected to a high-frequency converter 4 in order to feed high-frequency power of 100 to 2000 Watts. The trembler coil 31 is made out of Litz wires which are formed by twisting dozens to hundreds of threads in bundles, which wires are coated with heat-resistant resin in consideration of heat transfer.

An alternating voltage of 10 to 100 (kHz) is applied to the trembler coil 31 by the high-frequency converter 4. Magnetic flux inducted by the alternating current passes through the inside of the magnetic substance core 32 without leaking to the outside. The magnetic flux does not leak to the outside of the magnetic substance core 32 until the magnetic flux reaches the protruding portion 32*a* of the magnetic substance core 32. The leaked magnetic flux travels through the electromagnetic induction heating layer 16 in the fixing roller 1. Thereby an eddy current flows through the electromagnetic induction heating layer 16. Therefore, Joule heat is generated in the electromagnetic induction heating layer 16 to put the fixing roller 1 in a heating state.

A temperature sensor 6 is disposed to come in contact with the surface of the fixing roller 1. The temperature sensor 6 is typified by a thermister for sensing the surface temperature of the fixing roller 1.

The temperature sensor 6 is connected to a control circuit 5. The control circuit 5 controls temperature of the fixing roller 1 based on a detection signal of the surface temperature of the fixing roller 1, which signal is inputted from the temperature sensor 6. Specifically, based on the signal from the temperature sensor 6, the control circuit 5 controls the high-frequency converter 4 which increases or decreases power supply to the trembler coil 31 so that the surface temperature of the fixing roller 1 is automatically controlled to be kept at a specified temperature.

Description is now given of the operation of the fixing device. The pressure roller 2 is rotationally driven, and the fixing roller 1 is driven by the rotation of the pressure roller 2. Further, the electromagnetic induction heating layer 16 in the fixing roller 1 is heated by electromagnetic induction derived from change of magnetic flux generated by the magnetic flux generation means 3. The surface temperature of the fixing roller 1 is automatically controlled so as to be kept a specified temperature. Then, the recording material (i.e. sheet) P, on which the unfixed (toner) image t are carried to be formed, is transported from an imaging means (unshown) and guided to the nip N between the fixing roller 1 and the pressure roller 2. In this case, the fixing roller 1 faces the surface of the recording material P on which surface the unfixed image t is carried to be formed.

The recording material P guided to the nip N is held and transported by the nip N, and is heated by the fixing roller 1 so that the unfixed image t is melted and fixed to the recording material P.

The recording material P passed through the nip N is separated from the fixing roller 1 and is transported for discharge. A separation nail 8 is disposed in such a manner as to come in contact with the surface of the fixing roller 1. The separation nail 8 serves to forcefully separate the recording material P from the fixing roller 1 when the recording material P sticks to the surface of the fixing roller 1 after passing the nip N. Thereby, the separation nail 8 prevents a paper jam.

In the fixing roller 1, the elastic layer 17 and the release layer 18 are swiftly heated since the electromagnetic induction heating layer 16 has not only low heat capacity but also the electromagnetic induction heating layer 16 is insulated by the sponge layer 12. Therefore, the surface of the fixing roller 1 quickly reaches a temperature necessary for fixing operation, and also heat is sufficiently fed even if the recording material P removes heat.

Further, flexibility of the electromagnetic induction heating layer 16 insulated by the sponge layer 12 is utilized in this embodiment. In formation of the nip N between the fixing roller 1 and the pressure roller 2, therefore, it is possible to form the nip N with a width size larger than ever before even if the elastic layer 17 is made as thin as 200 μm. Also, generation of micro gloss is prevented, and sufficient separability is secured even if recording material which tend to wind around the fixing roller 1, such as an OHP sheet, is used.

Figure 3:
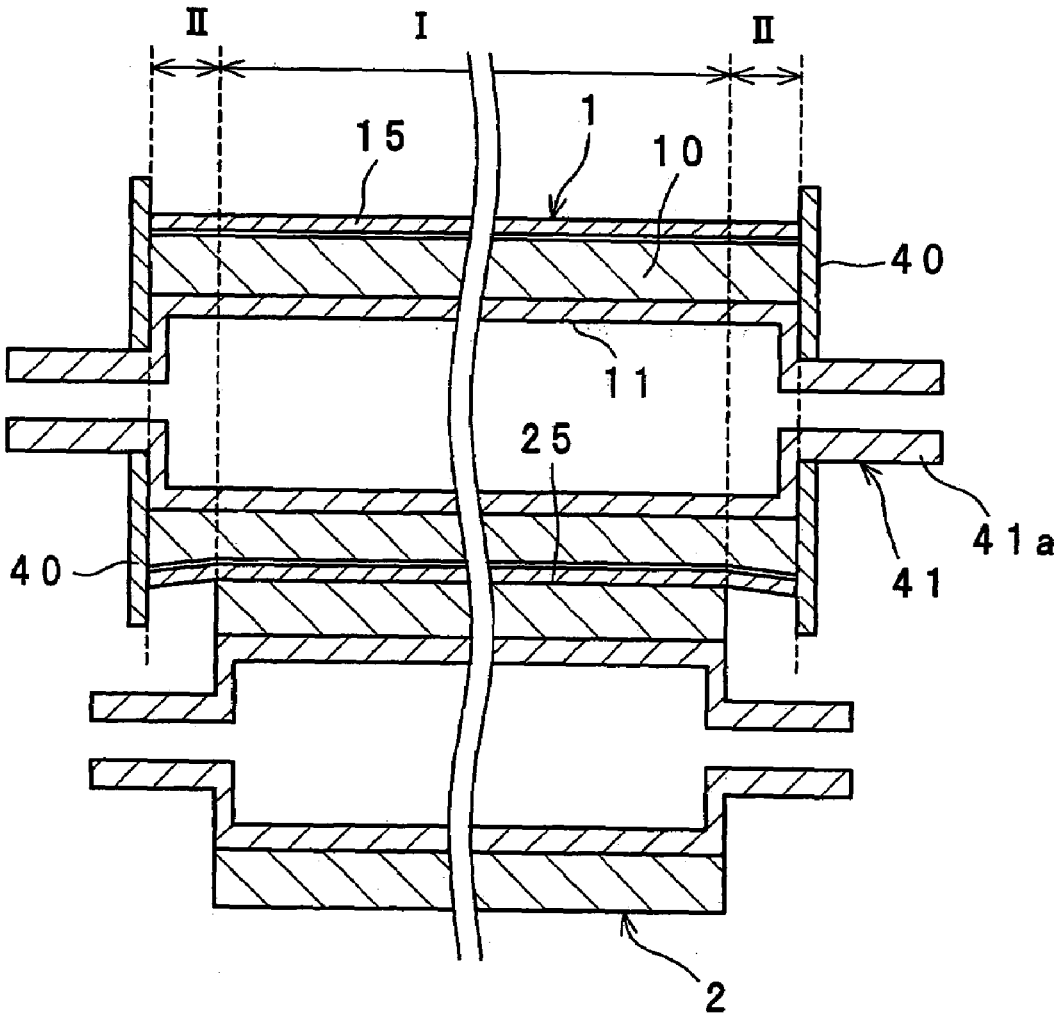
FIG. 3 is a cross sectional view showing the fixing roller and a pressure roller.

As shown in FIG. 3, the fixing roller 1 includes a pair of regulation members 40, 40 which is disposed outside of both ends of the roller portion 15 in the axial direction in order to regulate axial movement of the outside roller 15 with respect to the inside roller 10.

More specifically, the regulation member 40 has a annular shape. A shaft portion 41*a* of a core member 41 which constitutes the support layer 11 is fitted and fastened into the inner surface of a center hole of the regulation member 40. A pair of the regulation members 40, 40 sandwich both ends of the outside roller 15 from outside so as to regulate axial movement of the outside roller 15.

Further, an axial length of a contact face 25 of the pressure roller 2 which contacts with the outside roller 15 of the fixing roller 1 is smaller than an axial length of the outside roller 15. The axial length of the inside roller 10 of the fixing roller 1 almost equals the axial length of the outside roller 15.

Herein, the contact face 25 of the pressure roller 2 is defined as a contact trace formed on the outer peripheral face of the pressure roller 2 when the pressure roller 2 rotates at least once under the contact with the fixing roller 1.

The outer circumferential face of the fixing roller 1 has an outside roller free region II, a nip formation region I and the outside roller free region II. Those regions are positioned in sequence from one end to the other end of the fixing roller 1 in the axial direction. The outside roller free region II is defined as a region in which the pressure roller 2 and the outside roller 15 of the fixing roller 1 do not come in contact with each other. The nip formation region I is defined as a region in which the pressure roller 2 and the outside roller 15 of the fixing roller 1 come in contact with each other.

The inside roller 10 and the outside roller 15 are not bonded. A pair of regulation members 40, 40 are disposed outside of both ends of the axial direction of the outside roller 15. Therefore, the regulation member 40 regulates axial movement (e.g. prevents meandering or one-directional deviation) of the outside roller 15 when the fixing roller 1 and the pressure roller 2 rotate in contact with each other.

In this case, since an axial length of the contact face 25 of the pressure roller 2 is smaller than an axial length of the outside roller 15 in the fixing roller 1, both ends (the outside roller free regions II) of the outside roller 15 hardly receive bending deformation (elastic deformation) caused by pressure of the pressure roller 2.

Thus, both ends of the outside roller 15 come in contact with the regulation member 40 in the state of an almost genuine circle when viewed from the axial direction. Therefore, stress exerted to both ends of the outside roller 15 is reduced (to the pressing force from the regulation member 40), which allows prevention of crack on both ends of the outside roller 15 and makes it possible to elongate the life of the fixing roller 1.

Further, the picture quality of the recording material P passing the fixing roller 1 is enhanced since the regulation member 40 prevents axial movement (e.g. meandering) of the outside roller 15 when the fixing roller 1 is rotated.

The regulation member 40 is fastened to the core member 41. Thus, the regulation member 40 rotates together with the inside roller 10 and the outside roller 15, which decreases stress exerted to the ends of the outside roller 15. This makes it possible to prevent the ends of the outside roller 15 from being damaged.

No adhesive agent is used between the inside roller 10 and the outside roller 15, and therefore, the problem that the adhesive agent between the inside roller 10 and the outside roller 15 comes off is eliminated, so that not only enhancement of durability can be expected but cost reduction of the adhesive agent can be achieved.

An axial length between the peripheral edge of the pressure roller 2 and the peripheral edge of the outside roller 15 of the fixing roller 1 is greater than or equal to 10 mm.

That is, an axial length of the outside roller free region II is greater than or equal to 10 mm. This makes it possible to further reduce the bending deformation on both ends of the outside roller 15 in the fixing roller 1, thus to reliably prevent both ends of the fixing roller 1 from being damaged. On the contrary, if the axial length of the outside roller free region II is smaller than 10 mm, the bending deformation becomes disadvantageously larger on both ends of the outside roller 15 in the fixing roller 1.

Figure 13:
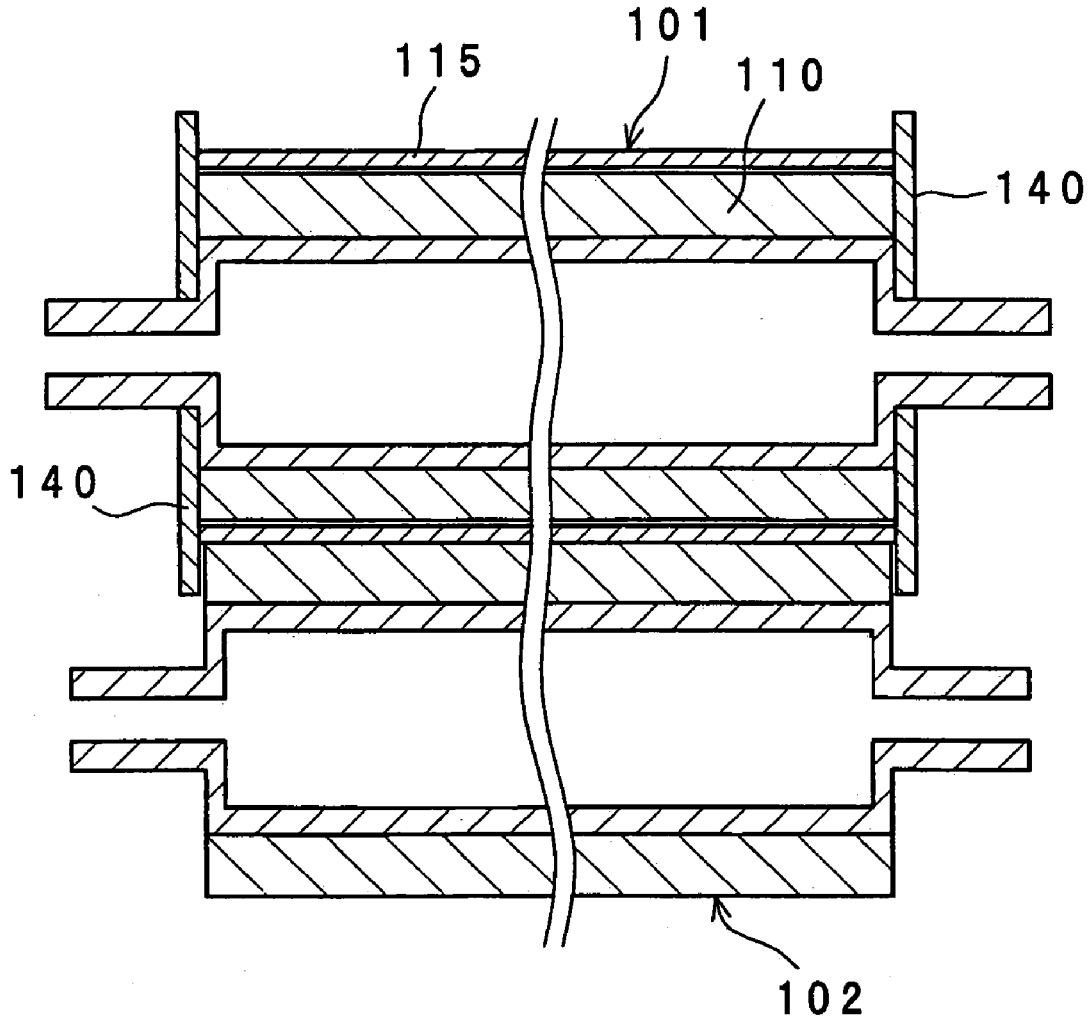
FIG. 13 is a cross sectional view showing a comparative example of the fixing device of the present invention.

As a comparative example of the first embodiment, description is herein given of the case as shown in FIG. 13, where an axial length of the contact face of a pressure roller 102 is almost equal to an axial length of an outside roller 115 in a fixing roller 101.

Specifically, no adhesive agent is used between an inside roller 110 and the outside roller 115, and a regulation member 140 is disposed outside of both ends of the outside roller 115 in the axial direction. The regulation member 140 regulates axial movement (meandering or one-directional deviation) of the outside roller 115.

In this example for comparison, when the fixing roller 101 and the pressure roller 102 rotate in contact with each other, both ends of the outside roller 115 come in contact with the regulation members 140 while receiving bending deformation caused by pressure of the pressure roller 102.

More particularly, both ends of the outside roller 115 receive a press force (radial direction stress) by the pressure roller 102 and another press force (thrust direction stress) by the regulation member 140. These press forces may cause a problem that the ends of the outside roller 115 crack and break.

Second Embodiment

Figure 4:
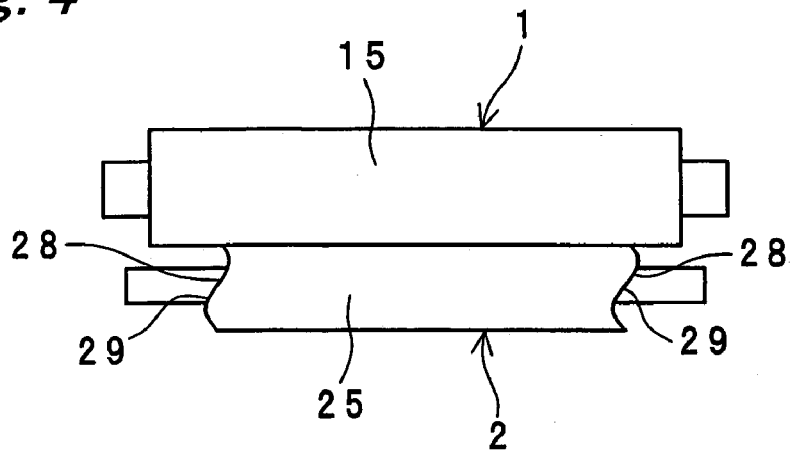
FIG. 4 is a schematic view showing modification of the pressure roller in another embodiment.

FIG. 4 shows a fixing device according to a second embodiment of the present invention. Description is given of the difference from the first embodiment. In the second embodiment, an edge 29 of the pressure roller 2 is not in a straight line form but in a wave form. Specifically, the edge 29 of the pressure roller 2 is a meandering curved line when viewed from a direction orthogonal to an axis of the pressure roller 2.

Thus, the outside roller 15 in the fixing roller 1 is less susceptible to developing creases and flaws when the pressure roller 2 presses the fixing roller 1 because the edge 29 of the pressure roller 2 is a meandering curved line. That is, damage is prevented in a boundary portion between the nip formation region I and the outside roller free region II as shown in FIG. 3.

On the contrary, in the case where the edge 29 of the pressure roller 2 is a straight line when viewed from the direction orthogonal to the axis of the pressure roller 2, the outside roller 15 in the fixing roller 1 is susceptible to creases and flaws during the pressure roller 2 presses the fixing roller 1.

Third Embodiment

Figure 5:
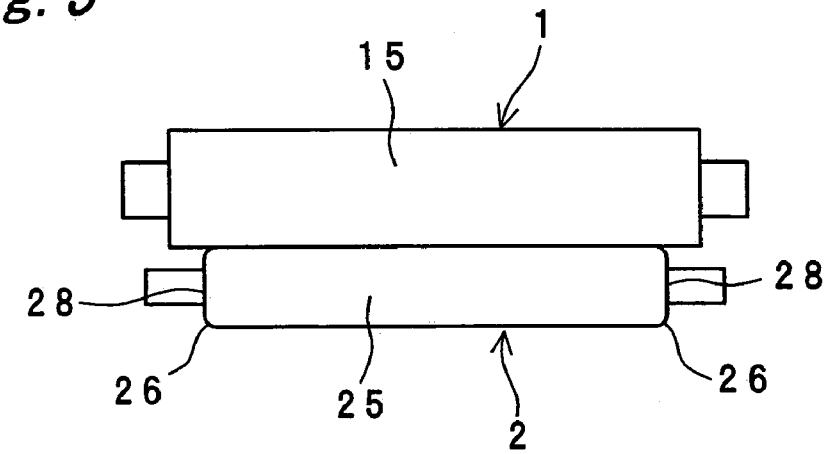
FIG. 5 is a schematic view showing modification of the pressure roller in yet another embodiment.

FIG. 5 shows a fixing device according to a third embodiment of the present invention. Description is given of the difference from the first embodiment. In the third embodiment, an edge between the end face 28 and the contact face 25 in the pressure roller 2 is formed into a convex curve face 26. In other words, the edge of the pressure roller 2 is roundly chamfered.

Since the edges of the pressure roller 2 have the convex curve face 26, it becomes difficult to form creases and flaws in the outside roller 15 of the fixing roller 1 when the pressure roller 2 presses the fixing roller 1. In other words, damage is prevented in the boundary portion between the nip formation region I and the outside roller free region II as shown in FIG. 3.

Fourth Embodiment

Figure 6:
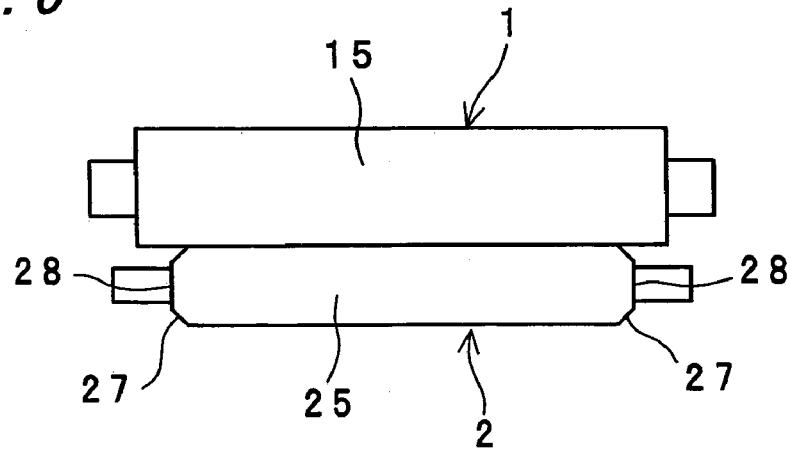
FIG. 6 is a schematic view showing modification of the pressure roller in still another embodiment.

FIG. 6 shows a fixing device according to a fourth embodiment of the present invention. Description is given of the difference from the first embodiment. In the fourth embodiment, an edge between the end face 28 and the contact face 25 of the pressure roller 2 is formed into a taper face 27.

Thus, since the edges of the pressure roller 2 has the taper face 27, it also becomes difficult to form creases and flaws in the outside roller 15 of the fixing roller 1 when the pressure roller 2 presses the fixing roller 1.

Fifth Embodiment

Figure 7:
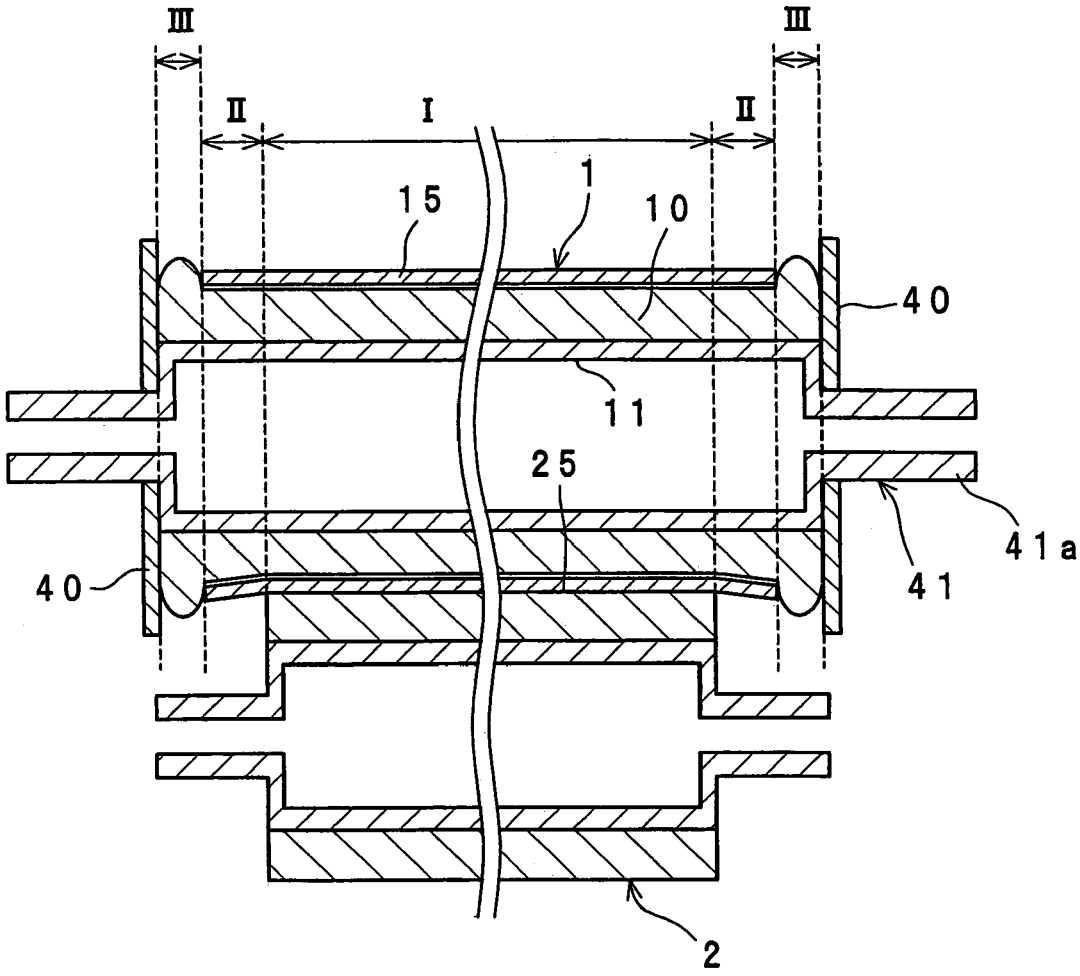
FIG. 7 is a cross sectional view showing a fixing roller and a pressure roller in another embodiment.

FIG. 7 shows a fixing device according to a fifth embodiment of the present invention. Description is given of the difference from the first embodiment. In the fifth embodiment, an axial length of the inside roller 10 is larger than an axial length of the outside roller 15, and a pair of the regulation members 40, 40 are disposed outside of both ends of the inside roller 10 in the axial direction.

The outer circumferential face of the fixing roller 1 has an inside roller free region III, the outside roller free region II, the nip formation region I, the outside roller free region II and the inside roller free region III. Those regions are positioned in sequence from one end to the other end of the fixing roller 1 in the axial direction. The inside roller free region III is defined as a region in which the outside roller 15 does not overlap with the inside roller 10.

Since the fixing roller 1 has the inside roller free region III, the outer diameter of the inside roller 10 becomes larger at both ends thereof than the inner diameter of the outside roller 15 when the inside roller 10 is expanded in the radial direction by thermal expansion and the like. Therefore, both ends of the inside roller 10 are interposed between the outside roller 15 and the regulation member 40.

Therefore, both ends of the inside roller 10 having the soft sponge layer 12 regulate axial movement (e.g. meandering or one-directional deviation) of the outside roller 15. Thereby, stress exerted to both ends of the outside roller 15 is further reduced.

Sixth Embodiment

Figure 8:
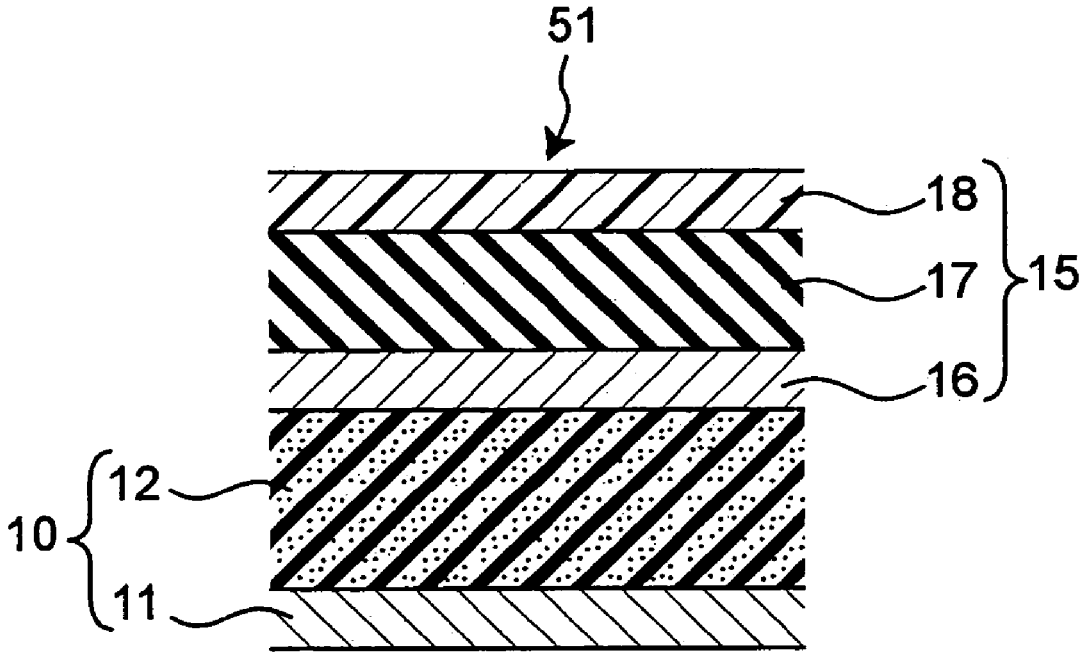
FIG. 8 is an enlarged cross sectional view showing layers of a fixing roller in an embodiment.

FIG. 8 shows a fixing device according to a sixth embodiment of the present invention. Description is given of the difference from the first embodiment. In the sixth embodiment, an inside roller 10 of a fixing roller 51 has the support layer 11 and the sponge layer 12, which are disposed in sequence from the inside to the outside in the radial direction, but the inside roller 10 does not have the protective layer 13.

Figure 9:
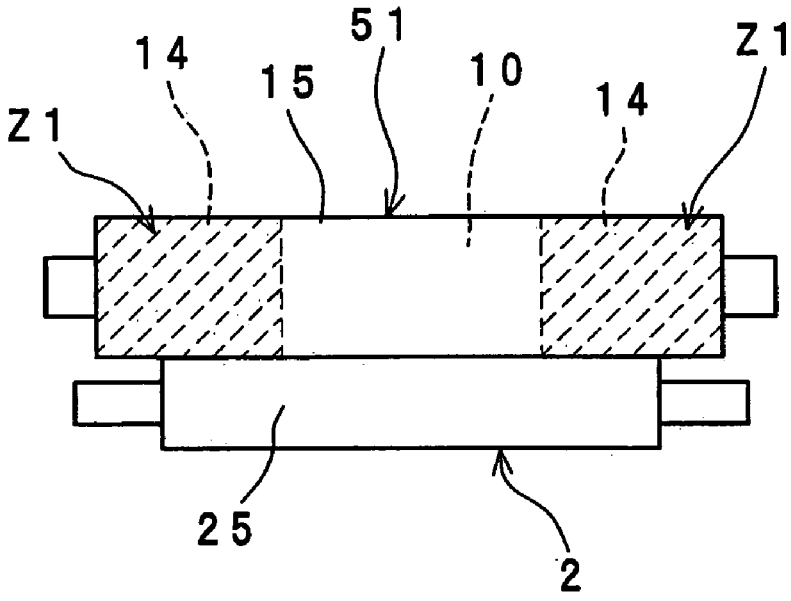
FIG. 9 is a schematic view showing a fixing roller and a pressure roller in another embodiment.

As shown in FIG. 9, the fixing roller 51 has an adhesive agent 14 (as an example of the regulation member) applied between the outside roller 15 and the inside roller 10 only at both ends thereof in order to connect the outside roller 15 to the inside roller 10. In other words, the outside roller 15 and the inside roller 10 are fastened by bonding the outside roller 15 and the inside roller 10 at their ends. The adhesive agent 14 suppresses movement of the outside roller 15 in relation to the inside roller 10 in both axial and radial directions.

In this embodiment, it is to be noted that the reference numerals identical to those in the first embodiment represent the structures similar to the first embodiment, and therefore, description thereof is omitted.

As apparent from the above description, an adhesion region Z1, where the adhesive agent 14 is applied, is located at the ends of both the outside roller 15 and the inside roller 10. Further, an axial length of the contact face 25 of the pressure roller 2 is smaller than an axial length of the outside roller 15 in the fixing roller 51. Thereby, both ends of the outside roller 15 hardly receive bending deformation caused by pressure of the pressure roller 2 when the fixing roller 51 and the pressure roller 2 rotate in contact with each other. This prevents the adhesive agent 14 between both ends of the outside roller 15 and the inside roller 10 from coming off, and makes it possible to maintain durability of the fixing roller 51.

An axial length of the adhesion region Z1 is preferably not more than ½, more preferably not more than ⅓, of the total axial directional length of the fixing roller 51, that is, the outside roller 15. Thereby, removal and deformation of the outside roller 15 can be reliably prevented. On the contrary, if the axial length of the adhesion region Z1 exceeds the above-stated value, then it becomes difficult to obtain effects of preventing removal and deformation of the outside roller 15.

Figure 14:
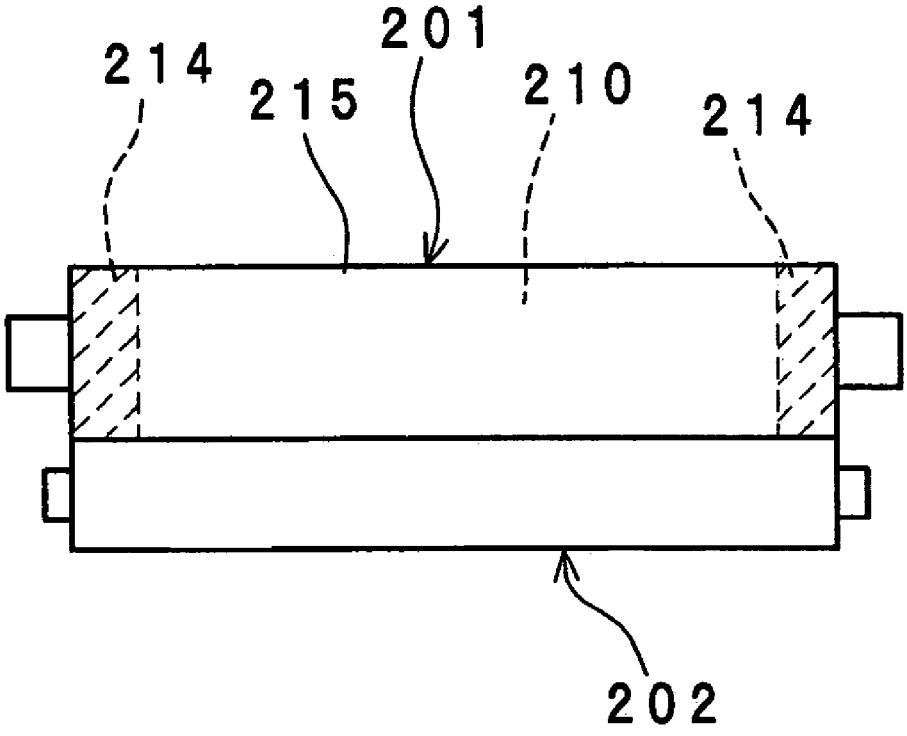
FIG. 14 is a schematic view showing another comparative example of the fixing device of the present invention.

Hereinafter, as an example for comparison with the sixth embodiment, description is given of the case as shown in FIG. 14 where an axial length of the contact face of a pressure roller 202 is almost equal to an axial length of an outside roller 215 in a fixing roller 201.

Specifically, an adhesive agent 214 (as an example of the regulation member) is applied between ends of both the outside roller 215 and an inside roller 210 in order to bond the outside roller 215 and the inside roller 210 to each other.

In this example for comparison, both ends of the outside roller 215 rotate under the state of receiving the bending deformation caused by pressure of the pressure roller 202 when the fixing roller 201 and the pressure roller 202 rotate in contact with each other. This is because the axial length of the contact face of the pressure roller 202 is almost equal to an axial length of the outside roller 215 in the fixing roller 201.

Particularly, the adhesive agent 214 between the outside roller 215 and the inside roller 210 may be peeled when both ends of the outside roller 215 repeatedly receive the bending deformation by rotation, which make it impossible to maintain durability of the fixing roller 201.

Seventh Embodiment

Figure 10:
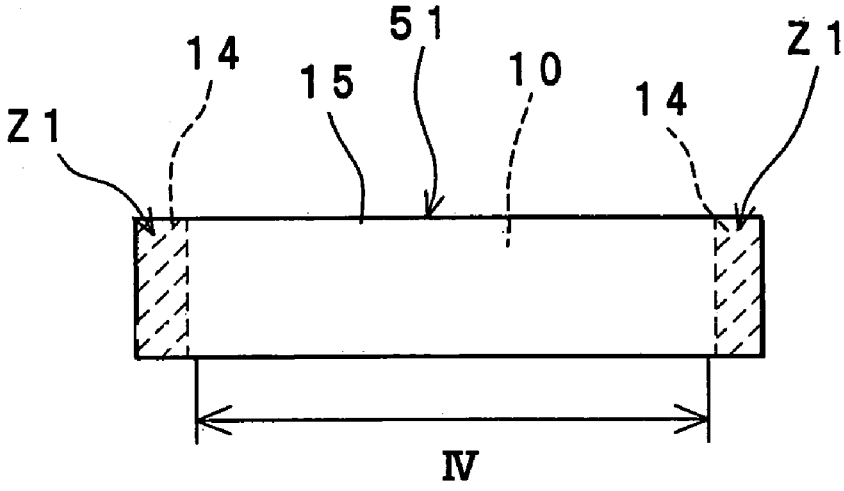
FIG. 10 is a schematic view showing a fixing roller and a pressure roller in yet another embodiment.

FIG. 10 shows a fixing device according to a seventh embodiment of the present invention. Description is given of the difference from the sixth embodiment. In the seventh embodiment, the outside roller 15 in the fixing roller 51 has a cylindrical paper passage region IV for facing the recording material P (see FIG. 1) in the axial center portion of the outside roller 15. The adhesion region Z1 is positioned outside of the cylindrical paper passage region IV in the axial direction, so that the adhesion region Z1 does not overlap with the cylindrical paper passage region IV. The cylindrical paper passage region IV, which contacts with the recording material P, has a width almost equal to the preset width of the recording material P.

Thus, the adhesion region Z1 does not overlaps the cylindrical paper passage region IV which faces the recording material P. Therefore, heat transfer and pressure change caused by adhesion of the adhesive agent 14 will not affect images on the recording material P. Thereby, good picture quality can be obtained. On the contrary, if the adhesion region Z1 overlaps with the cylindrical paper passage region IV, then heat transfer or pressure to the recording material P is transferred, which may affect images.

Eighth Embodiment

Figure 11:
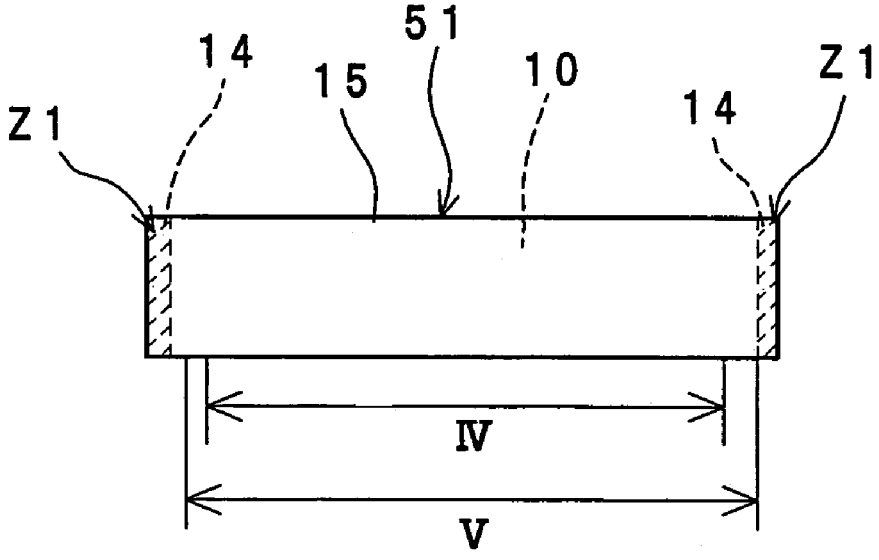
FIG. 11 is a schematic view simply showing a fixing roller and a pressure roller in still another embodiment.

FIG. 11 shows a fixing device according to an eighth embodiment of the present invention. Description is given of the difference from the seventh embodiment. In the eighth embodiment, the electromagnetic induction heating layer 16 (see FIG. 8) of the outside roller 15 in the fixing roller 51 has a cylindrical heat generation region V in the axial center portion of the outside roller 15. The adhesion region Z1 is positioned outside of the cylindrical heat generation region V in the axial direction, so that the adhesion region Z1 does not overlap with the cylindrical heat generation region V. The cylindrical heat generation region V, which is a region facing the trembler coil 31 (see FIG. 1), has a width larger than the cylindrical paper passage region IV.

Thus, since the adhesion region Z1 does not overlap with the cylindrical heat generation region V, it becomes possible to exclude the adhesion region Z1 from the high temperature region. This minimizes the influence of heat, and therefore, high durability is obtained. On the contrary, if the adhesion region Z1 overlaps with the cylindrical heat generation region V, then the temperature of the adhesive agent 14 is increased by the cylindrical heat generation region V, which disadvantageously affects adhesive property.

More specifically, in the case of a fixing device for A3 paper size, if small-size paper such as A4 size is passed through the fixing device, then temperature rises around the ends of the fixing roller where this small-size paper (A4) does not pass, which affects adhesive property of the adhesive agent. In the eighth embodiment, however, the adhesion region Z1 does not overlap with the cylindrical heat generation region V, which makes it possible to maintain the adhesive property of the adhesive agent and not to deteriorate the durability of the fixing device.

Ninth Embodiment

Figure 12:
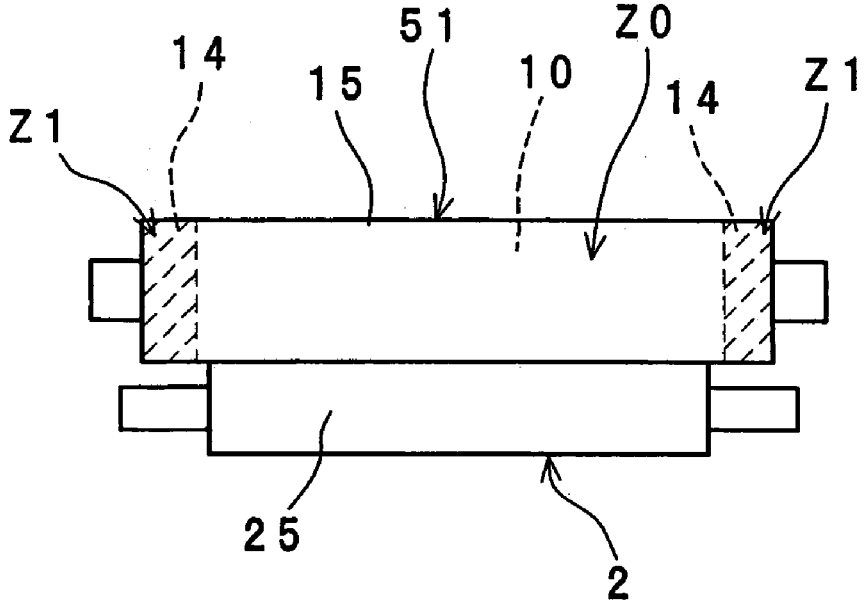
FIG. 12 is a schematic view showing a fixing roller and a pressure roller in still more another embodiment.

FIG. 12 shows a fixing device according to a ninth embodiment of the present invention. Description is given of the difference from the sixth embodiment. In the ninth embodiment, there are the adhesion region Z1 with the adhesive agent 14 and a non-adhesion region Z0 without the adhesive agent 14 in a facing region between the outside roller 15 and the inside roller 10. An axial length of the non-adhesion region Z0 is equal to or longer than an axial length of the contact face 25 of the pressure roller 2.

Accordingly, the adhesion region Z1 between the outside roller 15 and the inside roller 10 does not overlap with the contact face 25 of the pressure roller 2. Thereby, the adhesion region Z1 substantially receives almost no bending deformation caused by pressure of the pressure roller 2. This allows further enhancement of the durability of the adhesive agent between the outside roller 15 and the inside roller 10.

It is understood that the present invention should not be limited to the embodiments disclosed. For example, the fixing roller 1 may include other layers than the support layer 11, the sponge layer 12, the protective layer 13, the electromagnetic induction heating layer 16, the elastic layer 17 and the release layer 18. Further, the pressure roller 2 may be driven by the rotation of the fixing roller 51 which is rotated by the drive means 9. Furthermore, the regulation member 40, the adhesive agent 14 or the like may be disposed at least one end of the outside roller 15.

The invention being thus described, it will be obvious that the invention may be varied in many ways. Such variations are not be regarded as a departure from the spirit and scope of the invention, and all such modifications as would be obvious to one skilled in the art are intended to be included within the scope of the following claims.

What is claimed is:

1. A fixing device, comprising:

an outside roller having an electromagnetic induction heating layer;

an inside roller inserted into the outside roller, having a sponge layer and rotatably supported;

a regulation member for prohibiting the outside roller from moving in an axial direction in relation to the inside roller;

an induction coil for generating magnetic flux in the electromagnetic induction heating layer of the outside roller; and a pressure roller disposed in pressurized contact with the outside roller, the pressure roller being shorter than the outside roller in an axial direction.

2. The fixing device as defined in claim 1, wherein the regulation member contacts with an end of the outside roller in the axial direction so as to prohibit the outside roller from moving in the axial direction in relation to the inside roller.

3. The fixing device as defined in claim 2, wherein the regulation member is an annular member fixedly provided on the inside roller.

4. The fixing device as defined in claim 2, wherein the inside roller is longer than the outside roller in the axial direction, and the regulation member is provided on an end of the inside roller.

5. The fixing device as defined in claim 1, wherein the regulation member is an adhesion layer provided between the outside roller and the inside roller on both ends in the axial direction.

6. The fixing device as defined in claim 5, wherein a length of a nonadhesive region between the adhesion layers is equal to or larger than a length of the pressure roller.

7. The fixing device as defined in claim 1, wherein the inside roller is longer than outside roller.

8. The fixing device, as defined in claim 1, wherein an edge of the pressure roller is formed into a curved line when viewed from a direction orthogonal to the axial direction of the pressure roller.

9. The fixing device as defined in claim 1, wherein an edge of the pressure roller is formed into a convex curve face.

10. The fixing device as defined in claim 1, wherein an edge of the pressure roller is formed into a taper face.

11. A fixing device, comprising:

an outside roller having an electromagnetic induction heating layer;

an inside roller inserted into the outside roller, having a sponge layer and rotatably supported;

a regulation member provided on both ends of the inside roller and coming in contact with an end of the outside roller so as to prohibit the outside roller from moving in the axial direction;

an induction coil for generating magnetic flux in the electromagnetic induction heating layer of the outside roller; and a pressure roller disposed in pressurized contact with the outside roller, the pressure roller being shorter than the outside roller in the axial direction.

12. The fixing device as defined in claim 11, wherein an inner diameter of the outside roller is almost equal to an outer diameter of the inside roller.

13. A fixing device, comprising:

an outside roller having an electromagnetic induction heating layer;

an inside roller inserted into the outside roller, having a sponge layer and rotatably supported, the inside roller being bonded to the outside roller on both ends other than a center portion of the outside roller;

an induction coil for generating magnetic flux in the electromagnetic induction heating layer of the outside roller; and a pressure roller disposed in pressurized contact with the outside roller, the pressure roller being shorter than the outside roller in an axial direction.

14. The fixing device as defined in claim 13, wherein a length of a nonadhesive region between the adhesion layers is equal to or larger than a length of the pressure roller.

* * * * *